United States Patent [19]

Chen et al.

[11] 4,400,678

[45] Aug. 23, 1983

[54] FUSE SWITCH BOX

[76] Inventors: Chang C. Chen; Chei P. Chan, both of 7, Lane 12, Tsuey Hwa St., Pan Chiao Shih, Taipei Hsien, Taiwan

[21] Appl. No.: 258,812

[22] Filed: Apr. 29, 1981

[51] Int. Cl.[3] ..... H01H 85/22

[52] U.S. Cl. ..... 337/195; 337/196

[58] Field of Search ..... 337/194–196, 337/212; 361/340, 357, 360, 432

[56] References Cited

U.S. PATENT DOCUMENTS

| | | | |
|---|---|---|---|
| 1,253,761 | 1/1918 | Wolfsberg | 337/196 |
| 1,482,958 | 2/1924 | Ullrich | 337/196 |
| 2,636,955 | 4/1953 | George | 337/196 |

*Primary Examiner*—William H. Beha, Jr.

*Attorney, Agent, or Firm*—Karl W. Flocks; Sheridan Neimark

[57] ABSTRACT

A safe and simple fuse replacement device whereby facile exchange of fuse can be achieved by means of the introduction of the replacement fuse onto a tripper that will jump outwards as it is subjected to elastic pressure transferred by a spring mechanism.

4 Claims, 10 Drawing Figures

FUSE SWITCH BOX

SUMMARY OF THE INVENTION

The present invention provides for a safe and simple fuse replacement device, specifically it means a newly developed safe, simple exchange device that can serve to accommodate replacement of fuse instantly without tools.

It is known that for the fuse for use in switches or sockets on the walls, owing to the fact that they are always installed inside the mounting unit, which is, as a rule, fixed onto the wall with screws, therefore as a consequence, when it is required to repair or replace a broken fuse it is invariably necessary to loosen the fastened screws with screw-drivers before dismantling the mounting unit for repairing or replacement actions. All this dismantling and assembling work calls for labor and time, and what is still worse is that it wouldn't be possible to do such work at all if tools such as screw-drivers are not readily available. By logical reasoning and based on personal experience it becomes quite clear that generally speaking, people unacquainted with electricity would usually regard things like repairing or exchanging fuses as something formidably dangerous. They will often cut off the master switch to ensure security for themselves when obliged to fix it themselves. This is supposedly safe enough, but the fixing action would be all the more difficult at night.

The objective of the present invention is to provide for a newly structured, simple and safe fuse replacement device that can ensure an ameliorative effect in view of the shortcomings and drawbacks inherent in the conventional fuse fixtures in case of replacement as stated above.

For the simple, safe fuse replacement device as covered by the present invention there is provided a tripper on the mounting unit that will jump outwards when subjected to pressure as imposed by a spring mechanism. The interior of said tripper is provided with two grooves to accommodate cross-over linkage of the fuse tubes, a jutting foot is incorporated to each of the grooves to the effect that these two jutting feet will respectively get matched to two sockets with power input leads and output leads so as to form a closed circuit by virtue of passage of currents when the tripper closes upwards to lie parallel to the mounting unit; whereas when said tripper jumps toward the outside of the mounting unit as a result of the action of the spring mechanism, the two jutting feet positioned inside the tripper will get disengaged from the two sockets that are linked with the leads and power as stated above simultaneously so as to facilitate convenient replacement of fuse.

Therefore, another objective of the present invention lies in the provision of a safe and simple fuse replacement device characteristic in that the fuse is placed on a tripper that can be driven to jump towards the outside of the mounting unit by the action of a spring mechanism in order that replacement of fuse can be achieved without resorting to screw-drivers eliminating all the troubles ensuing from loosening the fastened screws fixed on the mounting unit, dismantling the latter, etc.

Still another objective of the present invention lies in the provision of a safe and simple fuse replacement device wherein the two groove seats meant to hold the fuse can permit safe replacement of fuse because of suspension of currents when the tripper jumps towards the outside of the mounting unit to effectuate exchanging of fuse, thereby rendering unnecessary the cutting off of the master switch, and therefore, replacement of fuse will in no way affect the routine use of the other household or otherwise electric appliances.

Still another objective of the present invention lies in the provision of a safe and simple fuse replacement device in order that the locking mechanism of the tripper thereof can be driven to cut out the master power switch by means of the rapid sprung overturn of the tripper to the outside of the mounting unit with the aid of a spring mechanism in case of emergency.

DETAILED DESCRIPTION

Figure 1:
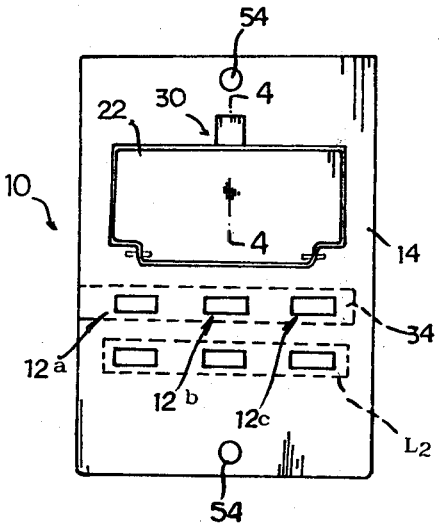
FIG. 1 shows the front view of the safe, simple fuse replacement device, namely, the present invention, as it is executed on the socket.
Figure 3:
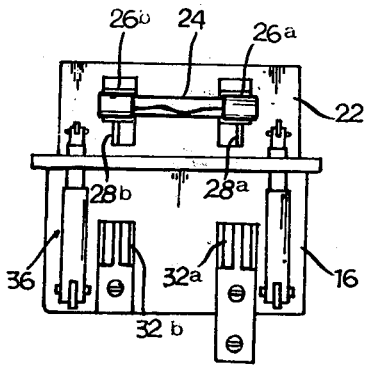
FIG. 3 gives the view of the correlative position illustrating how the tripper, as covered in FIG. 1, jumps towards the outside of the mounting unit to realize the replacement of fuse.
Figure 2:
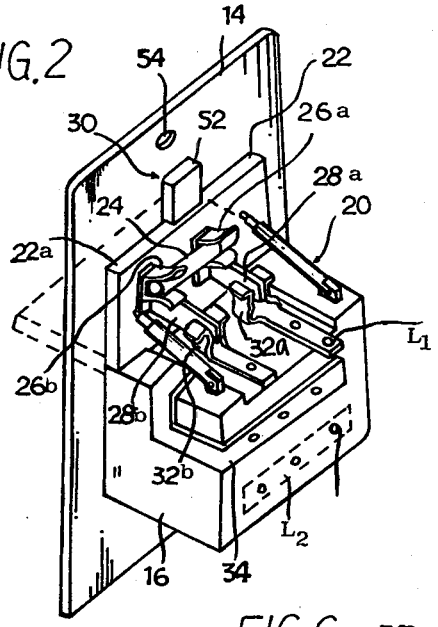
FIG. 2 shows the perspective view of the execution as given in FIG. 1, as seen from the back.

Now it is intended to give a description of the present invention in execution in the light of the illustration from FIG. 1 through FIG. 3, the component represented by the number 10 is the terminal socket for use on wall surface, consisting of three sets of insertion holes 12*a*, 12*b*, 12*c*, wherein these holes there are respectively provided socket spring pieces to permit intromission of plugs. Said socket spring pieces are laid in a seat-bed 16 that is annexed inside the mounting unit 14. Somewhere above the seat-bed 16 of the mounting unit (usually a plastic slab or the like) 14 there is provided a tripper 22 that will jump towards the outside under elastic pressure presented by a spring mechanism 20. In the tripper 22 there are duly provided two conductor-groove pieces 26*a*, 26*b* to facilitate cross-over connexion of the fuse tube 24 that houses the fuses with conductors provided on both ends, two jutting feet 28*a*, 28*b* are incorporated each to said groove pieces 26*a*, 26*b*, to the effect that when the tripper 22 shuts up upwards to lay levelwise with respect to the mounting unit 14 and thereafter locks up by means of a locking mechanism 30, these jutting feet 28*a*, 28*b* will get matched into the two sockets 32*a*, 32*b* as provided on the seat bed 16 respectively. By this time, current will manage to flow to the socket spring piece on the three sets of insertion holes since it has been achieved to connect the socket 32*a* to the power lead L1 and that the socket 32*b* is likewise connected to the upper socket spring piece of each of the three sets of insertion holes by means of a guider 34; the lower socket spring piece on the other three sets of insertion holes is however, connected to the other end of the power source through another guider L2. Therefore, at this juncture, currents are present in all the three sets of insertion holes 12*a*, 12*b*, 12*c*. They are therefore available for introduction of plugs to accommodate normal usage.

Figure 5:
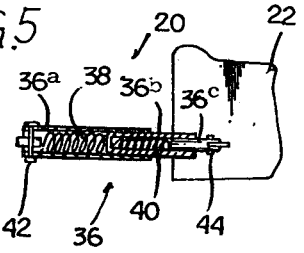
FIG. 5 gives the cross-section view of the spring mechanism taken the moment the tripper jumps over to the outside of the mounting unit.
Figure 6:
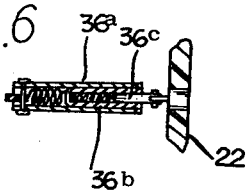
FIG. 6 gives the cross-section view of the spring mechanism the moment the tripper closes up upwards to lay levelwise on the mounting unit.

Referring to FIG. 2 and FIGS. 5, 6, the spring mechanism 20 as mentioned earlier is comprised of two parts, respectively installed in the three-section tubing 36 positioned at both sides of the interior of the tripper 22. One end of the tubing 36 is axially installed onto the seat bed 16 by means of a stub axis 42, the other end revolvably axially installed onto tripper 22 by means of another stub axis 44. In addition, tubing 36 is integrated as it is by orderly intromission of the three sections 36*a*, 36*b*, 36*c*, with compression spring 38, 40 provided at the ferrule joints respectively so as to permit the springs 38, 40 to induce whatever extent of extension is necessary with respect to the three-section ferrule tubing which will oppress tripper 22 to result in spontaneous jumping towards the outside of the mounting unit 22.

Figure 4:
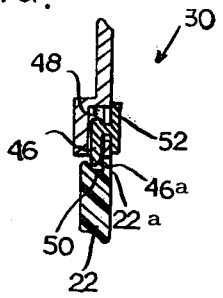
FIG. 4 gives the cross-section view of FIG. 1 along section of line 4—4.

As illustrated in FIGS. 1 & 4, the locking system works as follows. A tongue 46 that can shift up and down through an active spanner 52 is provided near the mobile end 22*a* close to tripper 22 on the mounting unit 14. Tongue 46 usually will remain at downward position due to thrust given by the spring 48 at its terminal, with its front end laid into the hole 50 at the mobile end 22*a* of tripper 22 so as to have tripper 22 shut up to cling levelwise onto the mounting slab 14. Furthermore, the mobile end 22*a* of the tripper 22 should be slightly sloped when tripper 22 is shut up in order that said mobile end 22*a* can move upwards smoothly against the slope 46*a* of the tongue 46.

For installation of the outlet socket 10 as covered by the present invention, the seat bed 16 inside the mounting slab 14 is disposed in the wall cavity and fastened with screw nails passing through the screw hole 54. When it is desired to change or repair a fuse in use it is not necessary to undo the screws with screwdrivers, but rather all that has to be done is to turn up the spanner 52 manually so as to drive the tongue 46 to shift upwards to drive its front end to leave the let-in position for coupling with the hole 50 at the mobile end of the tripper 22 and, by this juncture, tripper 22 will automatically jump toward the outside of the mounting slab 14 under the elastic force produced by the spring mechanism 30 resulting in the fuse tube being displayed outside the wall, and so the damaged fuse tube 24 can be taken out conveniently to facilitate the disposition of an unused fuse tube 24 into the two conductive groove pieces 26*a*, 26*b* that are linked to the tripper 22, and thence have the tripper 22 pushed upwards to its original position and lock up the locking mechanism 30 in a stable position. The moment the tripper 22 is driven to jump outwards to discharge the fuse, fuse replacement functions as stated above. The two jutting feet 28*a*, 28*b* as provided inside the tripper 22 get disengaged from the contact positions serving to link up with the outlet sockets 32*a*, 32*b* which simultaneously and thereby remain cleared of currents, and thus it becomes possible to make replacement of fuse safely without having to cut out the master switch of power.

Figure 7:
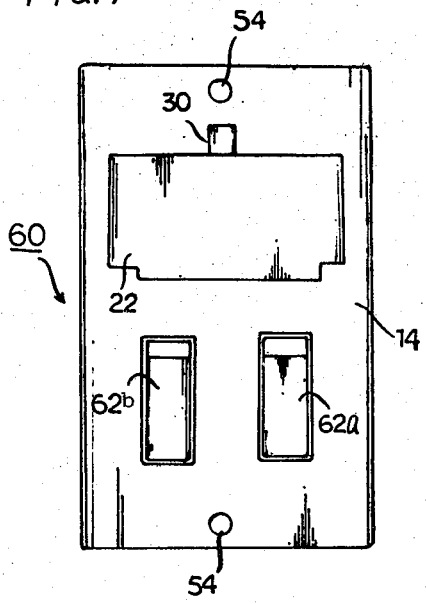
FIG. 7 gives the front view of the safe, simple fuse replacement device as covered by the present invention as it is put to use on the switch as used on wall.
Figure 8:
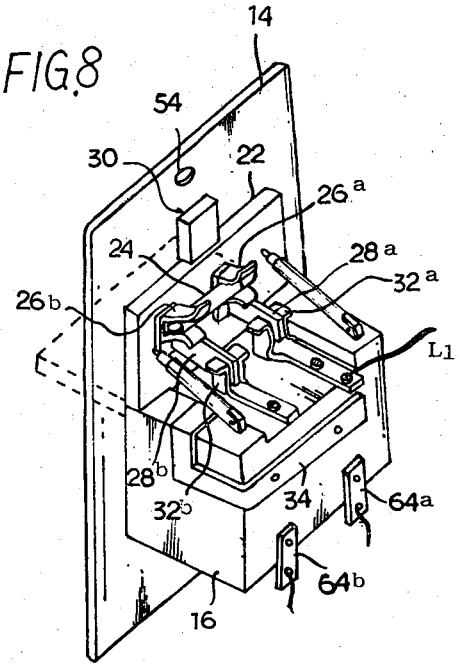
FIG. 8 is the rear perspective of the execution embodied in FIG. 7.

In addition, FIG. 7 and FIG. 8 make up as another instance of the present invention as it is executed on electric switches, wherein that part coded 60 serves as the switch for installation on the wall for use, said switch is provided with two sets of switching buttons 62*a*, 62*b* serving to exercise control over different electric appliances, 64*a* is the pole guider for the first button 62*a*, whereas 64*b* serves as the pole guider for the second button; all the other components and their mannerism of operations are exactly the same as the executions dealt with earlier in the text, so they will not be repeated for description. Identical number codes are given on the drawings to indicate like components with identical number codes as illustrated on preceding configurations.

Figure 9:
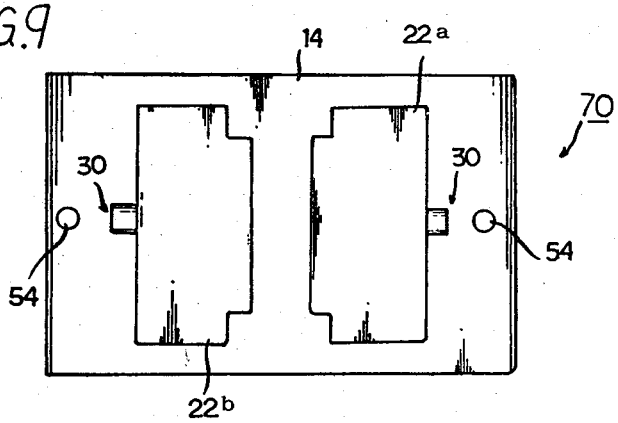
FIG. 9 gives the front view of the safe, simple fuse replacement device as covered by the present invention as it is put to use in the master switch.
Figure 10:
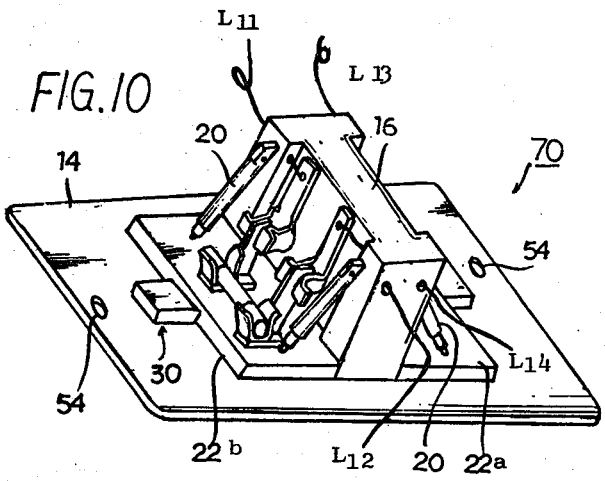
FIG. 10 is the rear perspective view of the instance executed in FIG. 9.

FIG. 9 and FIG. 10 demonstrate yet another instance of the present invention as it is executed on the master switches, wherein that part with code number 70 serves as the master switch for installation on the wall. On the right and left sides of the seat bed 16 on the other side of the mounting slab 14 there are provided on each side the trippers 22*a*, and 22*b* that will react to jump out spontaneously under pressures imposed by the spring mechanism 20 as described in the foregoing paragraphs. All the interior structure of the trippers and their operation principles are exactly the same as those described for the first instance of execution save that in FIG. 10 L11 is the input wire for positive power, L12 is the output wire for positive power, L13 is the input wire for negative power, L14 being the output wire for negative power.

I claim:

1. A fuse switch box with means to replace a fuse contained in a fuse tube comprising a mounting unit, a tripper in the form of a door pivotally mounted on said mounting unit and including on its interior a pair of grooved pieces to accommodate crossover linkage of a fuse tube, a jutting foot extending from each of said grooved pieces, sockets connected respectively to power input and power output leads and located to receive and couple to each of said jutting feet forming a closed electrical circuit when said tripper is in a closed position parallel to said mounting unit, compression spring mechanism biased against said tripper to bias it in an open position to detach said jutting feet from said sockets and thereby open the electrical circuit of the fuse, latching means to hold said tripper in the closed position against the bias of said compression spring mechanism whereby upon release of said latching means said tripper springs to an open position and quickly disconnects the electrical circuit including separating said jutting feet from said sockets.

2. The device as stated in claim 1, further characterized in that said spring mechanism thereof includes two sets of three-section ferrule tubing joints provided respectively at both sides inside said tripper, a compressive spring provided in each said ferrule joint whereby said three-section ferrule tubing joints can be extended at will subject to thrust from said springs so as to force said tripper to jump outward to the outside of said mounting slab.

3. The device as stated in claim 5, further characterized in the provision of mobile tongue that is supplemented with a spanner near the mobile end of said tripper on said mounting slab for said latching means as part thereof, said tongue let-in coupled into a hole at the mobile end of said tripper by a spring means locking said tripper onto said mounting unit.

4. The device as stated in claim 3, further characterized in that the mobile end of said tripper is slightly duly sloped.

* * * * *